US009845564B2

(12) United States Patent
Maderic et al.

(10) Patent No.: US 9,845,564 B2
(45) **Date of Patent: *Dec. 19, 2017**

(54) APPLIANCE HAVING A HOUSING DAMPENING PORTION AND METHOD

(75) Inventors: Jason K. Maderic, Louisville, KY (US); Weigang Qi, Westerville, OH (US); Anthony L. Rockwell, Pickerington, OH (US); Andrew J. Siwicki, Louisville, KY (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1046 days.

This patent is subject to a terminal disclaimer.

(21) Appl. No.: 13/339,989

(22) Filed: Dec. 29, 2011

(65) Prior Publication Data

US 2012/0169194 A1 Jul. 5, 2012

Related U.S. Application Data

(60) Provisional application No. 61/428,879, filed on Dec. 31, 2010.

(51) Int. Cl.
*D06F 37/20* (2006.01)
*D06F 39/00* (2006.01)

(52) U.S. Cl.
CPC ..... *D06F 39/001* (2013.01); *D06F 37/20* (2013.01)

(58) Field of Classification Search
CPC ..... D06F 37/20
See application file for complete search history.

(56) References Cited

U.S. PATENT DOCUMENTS 2,231,063 A 6/1943 Bohnke
2,703,974 A 3/1955 Clark et al.
(Continued)

FOREIGN PATENT DOCUMENTS

AU 2002301525 12/2003
DE 2531265 A1 * 7/1975
(Continued)

OTHER PUBLICATIONS

International Search Report and Written Opinion from PCT/US11/20124 dated Aug. 4, 2011.
(Continued)

*Primary Examiner* — Jason Ko
(74) *Attorney, Agent, or Firm* — Calfee, Halter & Griswold LLP

(57) ABSTRACT

Various embodiments of apparatuses and methods relating to appliances are provided. In one embodiment, an appliance having a housing, one or more moveable components inside the housing, a drive assembly, and a dampening portion is provided. The housing includes, for example, at least one side wall and the dampening member is disposed at least partially between the drive assembly and the at least one side wall. The dampening portion includes, for example, a resilient material having at least one surface extending at least partially along the side wall and the drive assembly. The dampening member is configured to limit movement of the drive assembly during shipping and handling to prevent damage to the appliance. The dampening member stays with the appliance after shipping and handling to enhance performance of the appliance, protect the moveable component, or both.

19 Claims, 8 Drawing Sheets

(56) References Cited

U.S. PATENT DOCUMENTS

| | | | |
|---|---|---|---|
| 2,879,655 | A | 3/1959 | McCormick |
| 3,132,098 | A | 5/1964 | Bochan |
| 3,216,225 | A | 11/1965 | Gil |
| 3,268,082 | A | 8/1966 | Galin |
| 3,295,541 | A | 1/1967 | Ummel |
| 3,301,428 | A | 1/1967 | Erickson |
| 3,579,609 | A | 5/1971 | Sevenich |
| 4,366,902 | A | 1/1983 | Fanson et al. |
| 4,661,392 | A | 4/1987 | Kapstad |
| 4,889,209 | A | 12/1989 | Sears |
| 4,985,106 | A | 1/1991 | Nelson |
| 5,044,705 | A | 9/1991 | Nelson |
| 5,056,341 | A | 10/1991 | Mori et al. |
| 5,307,928 | A | 5/1994 | Bishop |
| 5,515,702 | A | 5/1996 | Park |
| 5,533,367 | A | 7/1996 | Lybarger et al. |
| 5,570,597 | A | 11/1996 | Bongini |
| 5,647,257 | A | 7/1997 | Maida et al. |
| 5,679,145 | A | 10/1997 | Andersen et al. |
| 5,834,711 | A | 11/1998 | Haines |
| 5,855,353 | A | 1/1999 | Shaffer et al. |
| 5,934,107 | A | 8/1999 | Lee et al. |
| 6,152,259 | A | 11/2000 | Freist et al. |
| 6,196,029 | B1 | 3/2001 | Melia et al. |
| 6,514,889 | B1 | 2/2003 | Theoret et al. |
| 6,539,955 | B1 | 4/2003 | Tilton et al. |
| 6,595,321 | B1 | 7/2003 | Tompson |
| 6,669,265 | B2 | 12/2003 | Tilton et al. |
| 6,807,700 | B2 | 10/2004 | Panther et al. |
| 6,932,190 | B2 | 8/2005 | Sishtla |
| 7,014,160 | B2 | 3/2006 | Muyskens |
| 7,128,561 | B2 | 10/2006 | Rockwell et al. |
| 7,159,836 | B2 | 1/2007 | Parks et al. |
| 7,226,879 | B2 | 6/2007 | Tilton et al. |
| 7,251,962 | B2 | 8/2007 | Lim et al. |
| 7,357,974 | B2 | 4/2008 | Rockwell |
| 7,409,959 | B2 | 8/2008 | Retsema |
| 7,506,776 | B2 | 3/2009 | Podd |
| 7,685,665 | B2 | 3/2010 | Warmuth |
| 7,748,796 | B2 | 7/2010 | Rockwell et al. |
| 7,827,753 | B2 | 11/2010 | Nagarajan et al. |
| D629,556 | S | 12/2010 | Alter et al. |
| 7,923,092 | B2 | 4/2011 | Rockwell |
| 2001/0038722 | A1 | 11/2001 | Stone |
| 2002/0134615 | A1 | 9/2002 | Herreman et al. |
| 2005/0126848 | A1 | 6/2005 | Siavoshai et al. |
| 2005/0191921 | A1 | 9/2005 | Tilton et al. |
| 2006/0008614 | A1 | 1/2006 | Rockwell et al. |
| 2006/0008616 | A1 | 1/2006 | Dean et al. |
| 2006/0011628 | A1 | 1/2006 | Guevara |
| 2006/0090958 | A1 | 5/2006 | Coates et al. |
| 2006/0254854 | A1 | 11/2006 | Herrera et al. |
| 2006/0254855 | A1 | 11/2006 | Loftus et al. |
| 2007/0042156 | A1 | 2/2007 | Rockwell |
| 2007/0054090 | A1 | 3/2007 | Rockwell |
| 2007/0137926 | A1 | 6/2007 | Albin, Jr. |
| 2007/0212970 | A1 | 9/2007 | Rockwell et al. |
| 2007/0243366 | A1 | 10/2007 | Tilton et al. |
| 2007/0272285 | A1 | 11/2007 | Herreman et al. |
| 2008/0128005 | A1 | 6/2008 | Haeberle et al. |
| 2008/0135327 | A1 | 6/2008 | Matsumura et al. |
| 2008/0145630 | A1 | 6/2008 | Rockwell |
| 2008/0160857 | A1 | 7/2008 | Chacko et al. |
| 2008/0236637 | A1 | 10/2008 | Pyo et al. |
| 2008/0289664 | A1 | 11/2008 | Rockwell et al. |
| 2008/0317996 | A1 | 12/2008 | Rockwell |
| 2009/0038980 | A1 | 2/2009 | Rockwell et al. |
| 2009/0094908 | A1 | 4/2009 | Krueger et al. |
| 2009/0113843 | A1 | 5/2009 | Levit et al. |
| 2009/0224515 | A1* | 9/2009 | Breed et al. ..... 280/728.1 |
| 2009/0301022 | A1 | 12/2009 | Rockwell et al. |
| 2010/0024851 | A1 | 2/2010 | Rockwell et al. |
| 2010/0147621 | A1 | 6/2010 | Gillette |
| 2010/0187958 | A1 | 7/2010 | Colon |
| 2011/0069498 | A1 | 3/2011 | Alter et al. |
| 2011/0086214 | A1 | 4/2011 | Rockwell |
| 2011/0186473 | A1 | 8/2011 | Rockwell |
| 2011/0233086 | A1 | 9/2011 | Rockwell et al. |
| 2012/0200210 | A1 | 8/2012 | Rockwell |
| 2016/0101303 | A1 | 4/2016 | Rockwell |

FOREIGN PATENT DOCUMENTS

| | | |
|---|---|---|
| DE | 102005031487 | 7/2006 |
| EP | 591826 | 4/1994 |
| EP | 1751341 | 1/2011 |
| JP | 53-133194 | 11/1978 |
| WO | 04/103851 | 12/2004 |
| WO | 05/10674 | 10/2005 |
| WO | 2011/084953 | 7/2011 |

OTHER PUBLICATIONS

International Search Report and Written Opinion from PCT/US11/37701 dated Oct. 3, 2011.
International Search Report and Written Opinion from PCT/US11/020129 dated Mar. 23, 2011.
International Search Report and Written Opinion from PCT/US11/29943 dated Sep. 19, 2011.
Office action from U.S. Appl. No. 12/984,455 dated Sep. 12, 2013.
Office action from U.S. Appl. No. 121984,455 dated Jun. 4, 2014.
Office action from U.S. Appl. No. 121984,455 dated Sep. 12, 2014.
Office action from U.S. Appl. No. 12/984,455 dated Nov. 21, 2014.
Office action from U.S. Appl. No. 12/984,455 dated Mar. 13, 2015.
Office action from U.S. Appl. No. 12/984,455 dated Apr. 6, 2016.
Office action from U.S. Appl. No. 13/114,446 dated Apr. 17, 2014.
Office action from U.S. Appl. No. 13/114,446 dated Feb. 20, 2015.
Office action from U.S. Appl. No. 13/114,446 dated Sep. 15, 2015.
Office action from U.S. Appl. No. 13/499,756 dated Apr. 23, 2015.
Office action from U.S. Appl. No. 13/499,756 dated Oct. 2, 2015.
Office action from U.S. Appl. No. 13/114,446 dated Jun. 14, 2016.
Office action from U.S. Appl. No. 13/114,446 dated Nov. 18, 2016.
Notice of Allowance from U.S. Appl. No. 13/114,446 dated Apr. 5, 2017.

* cited by examiner

APPLIANCE HAVING A HOUSING DAMPENING PORTION AND METHOD

RELATED APPLICATION

This application claims the benefit of U.S. Provisional Patent Application Ser. No. 61/428,879 filed on Dec. 31, 2010, titled "Appliance Having Cavity Dampening Portion and Method". U.S. Provisional Patent Application No. 61/428,879 is incorporated herein by reference in its entirety.

BACKGROUND

Appliances such as clothes washers and driers, dish washers, etc., must be packaged before they leave a manufacturing facility in a manner that protects them from the hazards of transport until they reach their ultimate destination, which is typically a consumer's home. Along the way, an appliance may be loaded and unloaded from several locations and must be packaged for protection against inadvertent damage. Appliances such as vertical suspension clothes washers include an outer cabinet or housing containing a tub that is suspended in the cabinet and moved relative to the cabinet by a tub drive motor. Washers of this type are well known in the art and it is not unusual for such appliances to occasionally experience damage during shipping. It is also not unusual for such appliances to generate varying levels of sound or noise during operation in the consumer's home.

SUMMARY

Apparatuses and methods relating to appliances are provided. In one embodiment, an appliance having a housing, one or more moveable components inside the housing, a drive assembly, and a dampening portion is provided. The housing includes, for example, at least one side wall and the dampening member is disposed at least partially between the drive assembly and the at least one side wall. The dampening portion includes, for example, a resilient material having at least one surface extending at least partially along the side wall and the drive assembly. The dampening member is configured to limit movement of the drive assembly during shipping and handling to prevent damage to the appliance. The dampening member stays with the appliance after shipping and handling to enhance performance of the appliance, protect the moveable component, or both.

BRIEF DESCRIPTION OF THE DRAWINGS

The accompanying drawings incorporated herein and forming a part of the specification, illustrate several embodiments of the present invention and together with the description serve to explain certain principles of the invention.

DETAILED DESCRIPTION

Figure 1A:
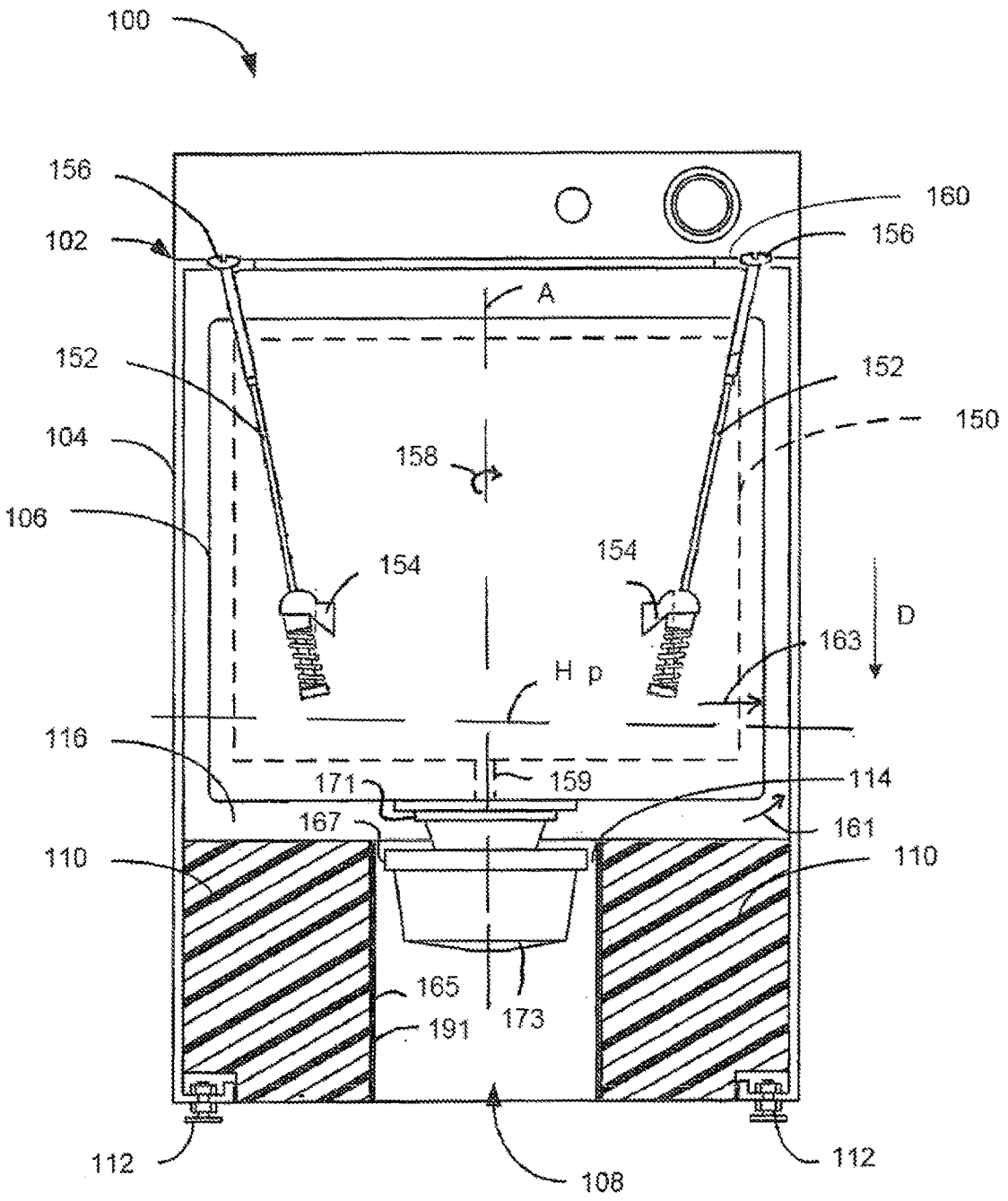
FIG. 1A is a cross-sectional view of one embodiment of an appliance having a dampening member configured to engage an external rotor of an appliance motor during shipping and handling of the appliance and/or during normal operation of the appliance to prevent damage to the appliance.

Prior to discussing the various embodiments, a review of the definitions of some exemplary terms used throughout the disclosure is appropriate. Both singular and plural forms of all terms fall within each meaning:

"Physical communication" as used herein, includes but is not limited to connecting, affixing, joining, attaching, fixing, fastening, placing in contact two or more components, elements, assemblies, portions or parts. Physical communication between two or more components, etc., can be direct or indirect such as through the use of one or more intermediary components and may be intermittent or continuous.

In the embodiments discussed herein, the dampening system of the present application is described for use with a washer, such as a washing machine or dishwasher, having a movable member such as a drive assembly. However, the dampening system of the present application may be used with a variety of other machines and appliances having a cavity into which a dampening system can reside, such as, for example, an air conditioner, a microwave oven, a refrigerator, a freezer, or any other household machine or appliance.

In accordance with one general embodiment, a combined shipping and operation dampening system is provided for a washer, such as a washing machine or dishwasher, including a cabinet having a top wall, side walls, and a cavity where a moveable member such as a drive assembly resides. The system includes a dampening portion in the form of a body contoured to fit in the cabinet's cavity. The dampening portion is positioned between at least one side wall of the cabinet's cavity and the drive assembly. The dampening portion functions to protect the drive assembly and associated components during shipping. When the washer reaches its final destination such as, for example, a consumer's home, the dampening portion remains in place to provide vibration dampening and acoustic and thermal insulation during washer operation.

In accordance with another general embodiment, a method is provided for both shipping and operation dampening of a washer including a cabinet having a top wall, sidewalls, and cavity where a moveable member such as a drive assembly resides. The method comprises the steps of positioning a dampening portion between the moveable member and a side wall of the cabinet. The dampening portion prevents the moveable member and associated components, such as a tub and/or basket, from impacting a sidewall of the cabinet or other component of the appliance during shipping. The dampening element remains in the cabinet to provide vibration dampening, and acoustic and thermal insulation and/or to prevent damage to the moveable member and associated components during washer operation.

Reference is now made to FIGS. 1A-1D, which illustrates in partial cross-section embodiments of a washing machine 100 having a dampening member 110. The term "washing machine", as used herein, is defined to mean a machine designed to wash laundry items, such as clothing, towels, and sheets, that uses water as the primary cleaning solution. The washing machine 100 illustrated in FIGS. 1A-1D is a "top loading" washing machine. The term "top loading", as used herein, is defined to mean that an internal basket configured to retain laundry items during the washing cycle is oriented in an upright position and that the laundry items enter the basket from a top opening in the washing machine 100. However, the concepts of the dampening system of the present application can be applied to any type of washing machine.

The washing machine 100 has a housing or cabinet 102. A tub 106, basket 150, and moveable member such as a drive assembly 108 reside within the cabinet 102. A dampening member 110 resides in a cavity 116 of the cabinet 102. The illustrated dampening member 110 is disposed below the tub 106, such that there is a vertical gap between the tub 106 and the dampening member 110. The illustrated dampening member 110 also includes an opening that is sized to provide a radial or outward space 114 between the outside of the drive assembly 108 and the dampening member 110. The outward space 114 and/or the vertical gap are selected such that the drive assembly 108 and/or the tub 106 engage the dampening member 110 before the tub 106 hits a sidewall or the drive assembly hits another internal component (not shown) of the washing machine.

As illustrated in FIGS. 1A-1D, the cabinet 102 is configured to provide an enclosure for the internal components of the washing machine 100. The illustrated cabinet 100 includes a top surface 160, at least one side wall 104, and legs 112 attached to bottom flanges. However, the cabinet 102 can take a variety of different forms. The cabinet 102 can be made from sheet metal and covered with a finish such as an enamel based finish. The cabinet can be made from a wide variety of different materials and/or combinations of materials. Examples of suitable materials for the cabinet include, but are not limited to plastic, fiberglass reinforced plastic, any type of sheet metal, etc. The cabinet 102 may have any finish. The cabinet 102 can be made from stainless steel sheet metal, and can have other desired finishes, such as for example a clear lacquer finish. The top surface 160 of the cabinet 102 includes an opening for loading laundry items. While the illustrated embodiment shows the cabinet as having a generally rectangular cross-sectional shape, it should be appreciated that the cabinet can have other cross-sectional shapes.

The tub 106 is suspended within the cabinet 102 and is configured to retain water used for washing the laundry items. The tub 106 can take a wide variety of different forms and can be made from a wide variety of different materials. The tub 106 may be generally cylindrical with an open top, but may take a variety of different shapes. The tub 106 may be made from plastic/polymeric materials, or metals, such as steel stainless steel, and aluminum. Preferably, the tub is made from a material that is resistant to corrosion when exposed to water or at least the inside surface of the tub is coated with a material that is resistant to corrosion when exposed to water.

The tub 106 may be connected to ends 154 of a plurality of suspension devices 152 with the other ends 156 of the suspension devices being coupled to the cabinet 102. In the illustrated embodiment, the ends 156 are connected to the top surface 160 of the cabinet. Details of suspension devices that may be used to support the tub 106 in the cabinet 102 are shown by U.S. Published Application Publication Number 2011/0233086, which is incorporated herein by reference in its entirety. However, the suspension devices can take a wide variety of different forms. The suspension devices can be any arrangement that is generally configured to allow vertical movement of the tub 106 with respect to the cabinet 102 while limiting rotational movement of the tub about vertical axis A as indicated by arrow D. For example, the tub 106 may be in the position illustrated by FIGS. 1A-1D when the tub is empty and move downward as indicated by Arrow D when the basket 150 is loaded with clothes and filled with water. The weight of the water and clothes acts against the countering forces applied by the suspension devices and moves the tub downward in the direction D. As such, when the washing machine 100 is in a wash or a rinse cycle, the tub 106 will be at a position lower than the position illustrated by FIGS. 1A-1D. When the washing machine 100 is in a spin cycle, (i.e., the water is removed from the tub 106 while the tub is rotating) the tub will be at or move upward toward the position illustrated by FIGS. 1A and 1B. In an exemplary embodiment, the tub 106 is spaced apart, above the dampening member 110 when the tub 106 is filled with water and clothes.

In one embodiment, the suspension devices are a combination of rods, springs and attachment mechanisms. However, the tub 106 may be coupled to the cabinet 102 in a wide variety of different ways. For example, the suspension devices can be any desired structure, mechanism or device sufficient to suspend the tub 106 within the cabinet 102. The suspension devices allow vertical movement of the tub 106 with respect to the cabinet 102, while limiting rotation of the tub about the vertical axis A, or otherwise couples the tub to the cabinet. In one exemplary embodiment, the suspension devices 152 allow the tub 106 and attached drive assembly to tilt with respect to a horizontal plane $H_p$ as indicated by arrow 161 and/or laterally move with respect to the horizontal plane $H_p$ as indicated by arrow 163. Under abnormal circumstances, the lateral movement or the titling could cause the tub 106 and/or the drive assembly 108 to hit another component of the appliance 100, potentially causing damage. For example, when a washing machine is shipped and handled, the washing machine may be placed at an angle, for example when being moved by a hand dolly, or placed on its side, resulting in tilting of the tub 106 and drive assembly with respect to the plane $H_p$ such that the tub 106 could hit a side wall 104 and/or the drive assembly 108 could hit another component of the machine 100. For example, when a washing machine is shipped and handled, it is not uncommon for the machine to be tilted between 30 and 60 degrees with respect to the horizontal plane $H_p$. Similarly, if a very unbalanced load were placed in the basket 150, the tub 106 could laterally move to the extent that the tub 106 could hit a side wall 104 and/or drive assembly 108 could hit another component of the machine 100. An example of a significantly imbalanced load would be loading only one side of the basket 150 with jeans or towels.

In the exemplary embodiment, the dampening member 110 prevents the tub 106 from hitting the sidewalls 104 and/or prevents the drive assembly 108 from hitting another component under these abnormal circumstances, to prevent damage to the machine. In an exemplary embodiment, the drive assembly 108 engages the dampening member 110 before the tub 106 hits one of the sidewalls 104 to prevent damage to the machine 100. In the embodiments illustrated by FIGS. 1A-1D, the space 114 is selected such that an inner surface 165 of the dampening member 110 engages an outer surface 167 of the drive assembly 108 to prevent the tub 106 from hitting the sidewalls 104 during shipping and handling and during abnormal operations, such as when the machine is operated with significantly imbalanced loads.

Referring again to the examples illustrated by FIGS. 1A-1D, the drive assembly 108 is positioned below the tub 106. The illustrated drive assembly 108 is configured to rotate the basket 150 via a shaft 159. However, the drive assembly 108 may take a wide variety of different forms and may be connected to the tub 106 and coupled to the basket 150 in many different ways. In the example illustrated by FIGS. 1A and 1B, the drive assembly 108 including an internal stator (not shown) that is fixedly connected to the bottom of the tub 106 by a bracket 171. An external rotor 173 is rotatably disposed around the stator. The external rotor 173 is connected to the shaft 159. Rotation of the external rotor 173 rotates the shaft 159 and the attached basket 150. In the example illustrated by FIGS. 1C and 1D, the drive assembly 108 includes a stator housing 181 that is fixedly connected to a bottom of the tub 106. An internal rotor 183 is rotatably housed in the stator housing. The rotor 183 is connected to the shaft 159. Rotation of the rotor 183 rotates the shaft 159 and the attached basket 150. Any rotor/stator configuration and coupling to the tub 106 and basket 150 may be employed. In an exemplary embodiment (See FIGS. 1C and 1D), the exposed portion of the drive assembly is fixed with respect to the tub 106. The exposed portion of the drive assembly 108 can have any cross-sectional shape, including the non-limiting examples of circular and square cross-sectional shapes.

Referring again to the example illustrated by FIGS. 1A-1D, the basket 150 is positioned within the tub 106 and configured to retain the laundry items during the washing cycle. The basket 106 can take a wide variety of different forms and can be made from a wide variety of different materials. The basket 150 may be generally cylindrical with an open top, but may take a variety of different shapes. The tub may be made from plastic/polymeric materials, or metals, such as steel, stainless steel, and aluminum. Preferably, the basket is made from a material that is resistant to corrosion when exposed to water or the tub is coated with a material that is resistant to corrosion when exposed to water.

As indicated above, during shipment or transport of a washing machine, the tub 106 and the drive assembly 108 connected to the tub may move relative to the cabinet 102. For example, the suspended tub 106 and drive assembly 108 may move vertically, swing, pivot relative to the plane $H_p$ of the cabinet, and/or laterally translate when the washing machine is moved, such as when it is tilted or laid on its side, or when the washing machine is moved in a vehicle that rapidly accelerates or travels over a rough surface. As such, the tub 106 and/or the drive assembly 108 may hit or otherwise contact the cabinet and/or components of the machine potentially damaging the components of the washing machine. For example, the tub 106 and the drive assembly 108 may tilt to one side and contact the side wall 104 of the cabinet 102 when the washing machine 100 is tilted, if the dampening element 110 were not present.

As illustrated in FIGS. 1A-1D, a portion of the dampening member 110 resides between the side wall 104 and the drive assembly 108. In one embodiment, the dampening member 110 is in physical communication with a portion of the side wall 104 and includes a space 114 proximate the drive assembly 108. The space 114 is provided to allow the drive assembly 108 various degrees of movement during shipping and/or operation. The various degrees of movement can include both contact and non-contact of the drive assembly 108 with the dampening member 110. As described herein, the dampening member 110 can have various shapes and configurations based on the particular shape and configuration of the cabinet 102 and its walls and the particular shape and configuration of the drive assembly. In this manner, the dampening member 110 provides protection to tub 152 and/or the drive assembly 108 during shipping and provides vibration dampening, acoustic and thermal insulation during normal operation as well as protection to the tub 152 and/or drive assembly during abnormal operation (i.e. severely imbalanced loads), as the dampening member 110 remains with the appliance after it has been delivered to its final destination.

As illustrated in FIGS. 1A-1D, when the washing machine 100 is moved during shipping, the dampening member 110 prohibits excessive swinging, pivoting, and lateral movement of the drive assembly 108 and the tub 106 to the cabinet 102. Furthermore, the dampening member 110 may limit the vertical movement of the tub 106 (or a portion of the tub i.e. tilting) and the drive assembly 108 relative to the cabinet 102. For example, the height of the dampening member 110 may be selected such that the tub engages the dampening member 110 if the tub or a portion of the tub moves downward further than the tub would move when filled with water and clothes during normal operation. As such, the dampening member 110 protects the components of the washing machine 100, such as the drive assembly 108, tub 106, and/or cabinet 102, from damage during shipment.

Figure 1B:
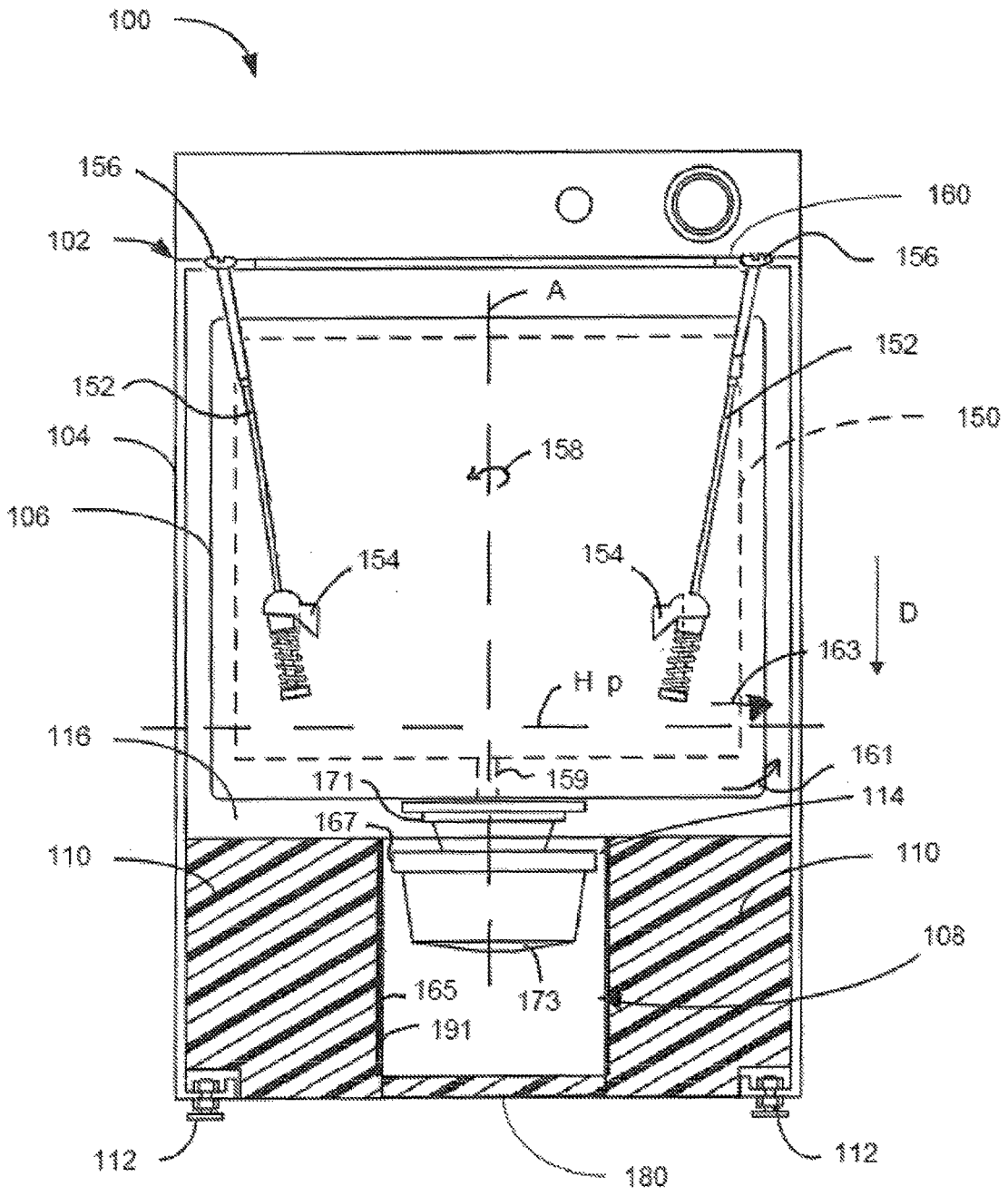
FIG. 1B is an embodiment similar to the embodiment illustrated by FIG. 1A where the dampening portion has a floor to reduce the amount of noise that escapes the appliance.
Figure 1C:
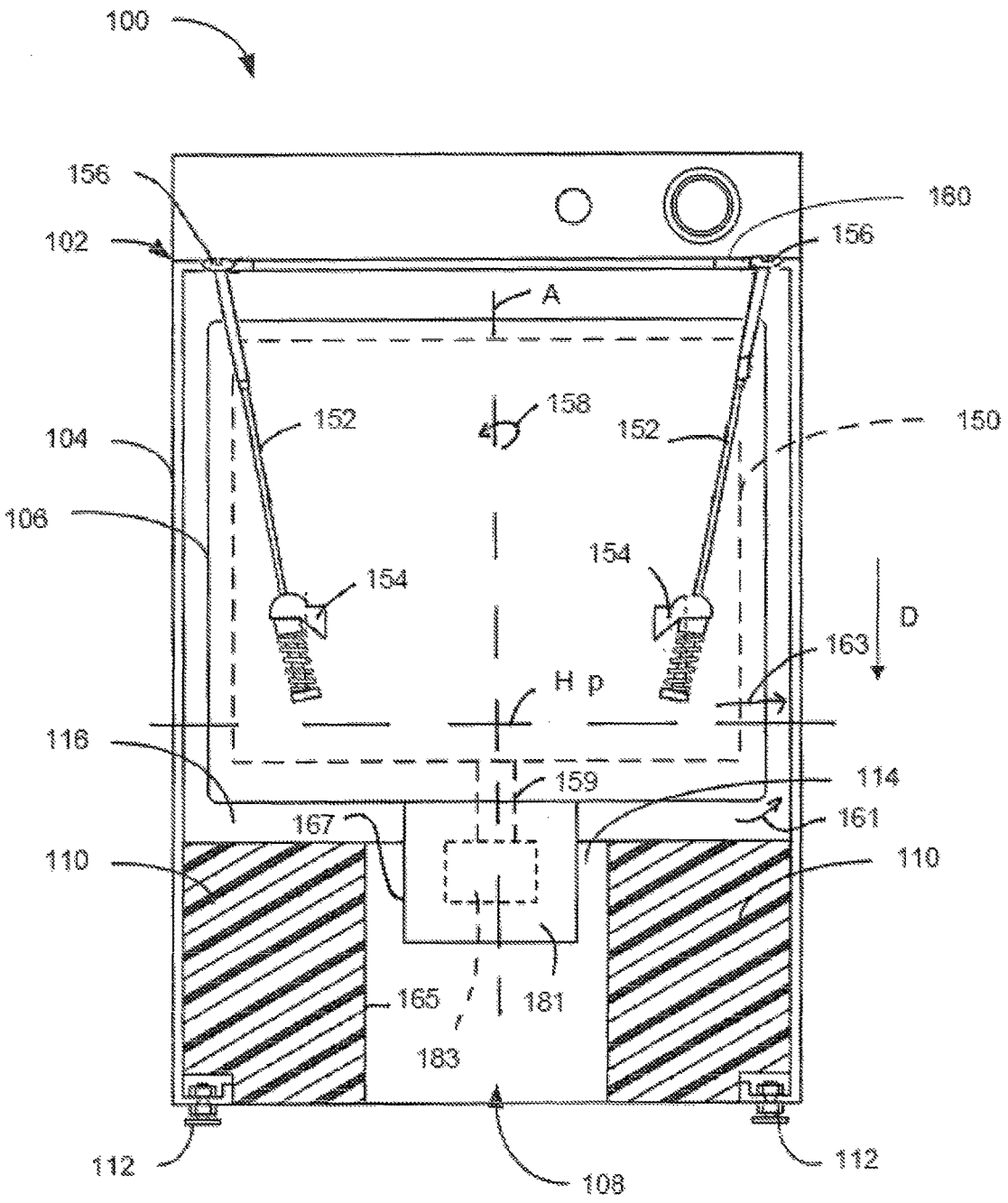
FIG. 1C is a cross-sectional view of an appliance having a dampening portion configured to engage a stationary external housing of an appliance during shipping and handling of the appliance and/or during normal operation of the appliance to prevent damage to the appliance.
Figure 1D:
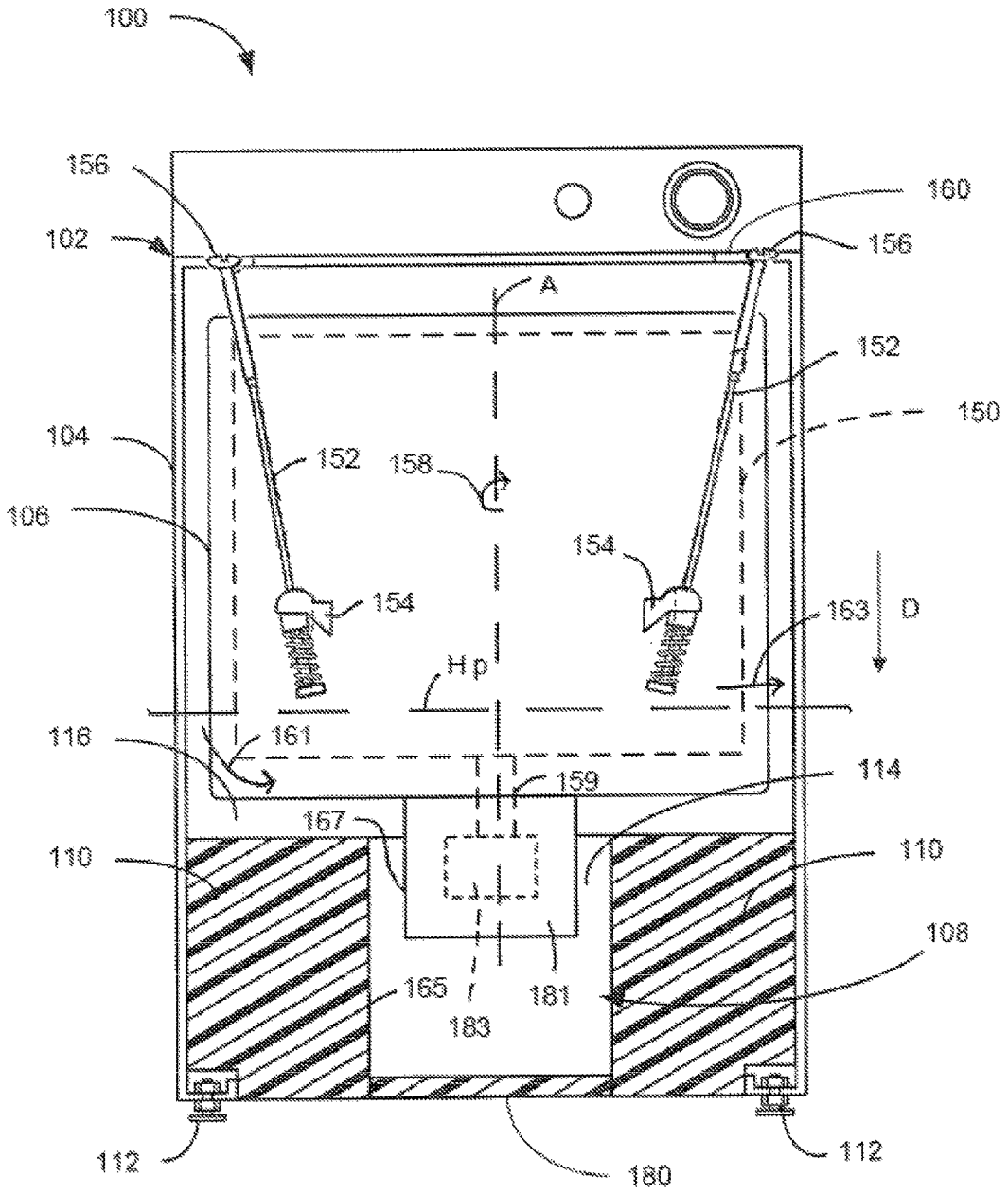
FIG. 1D is an embodiment similar to the embodiment illustrated by FIG. 1C where the dampening portion has a floor to reduce the amount of noise that escapes the appliance.

The dampening member 110 permits vertical movement of the tub 106 during operation of the washing machine 100. As stated above, the tub 106 will move downward in the direction D when it is filled with water. As illustrated in FIGS. 1A and 1B, the dampening member 110 is sized and shaped such that a space exists between the top of the dampening portion and the bottom of the tub 106 to permit vertical movement of the tub. In an exemplary embodiment, the dampening member 110 is resilient and compressible as to not completely inhibit movement of the drive assembly 108 and/or the tub 106 should they contact the dampening portion during operation or shipment. That is, the dampening member 110 is constructed to cushion impacts with the tub 106 and/or the drive assembly 108 without preventing all movement of the tub and/or the drive assembly once the impact occurs.

In the examples illustrated, the space 114 in the dampening member 110 extends through the dampening member 110. The space 114 is provided to allow the drive assembly 108 various degrees of movement during shipping and/or operation. In the examples illustrated by FIGS. 1B and 1D, the space 114 or opening extends only partially through the dampening member 110. As such, the dampening member 110 illustrated in FIGS. 1B and 1D acts as a floor for the machine 100. The floor provides an acoustic barrier between the drive assembly 108 and the bottom of the cabinet 102 to reduce the amount of noise that exits the cabinet. The closed bottom portion 180 (as well as other portions of the dampening member 110 may be made from a breathable material. The breathable material allows air to flow to the drive assembly 108 to facilitate cooling of the drive assembly.

Figure 2:
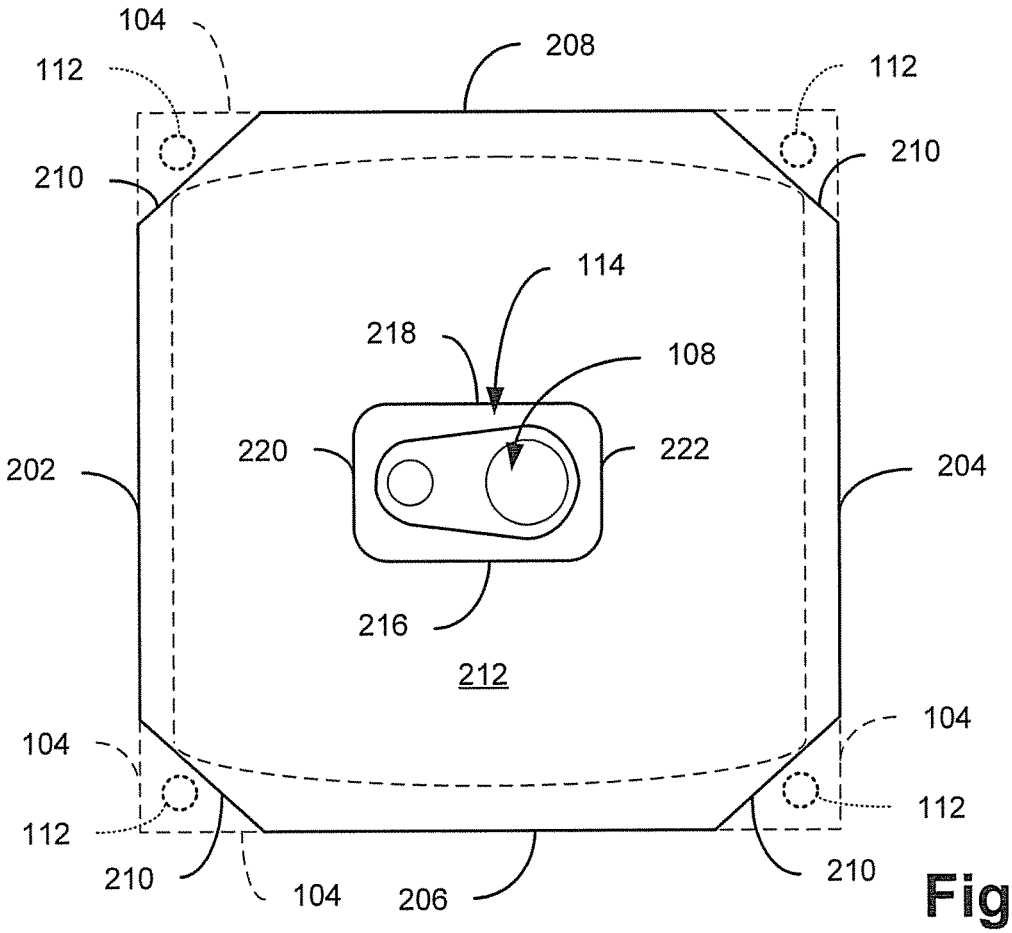
FIG. 2 is a bottom plan view of an exemplary embodiment of having a dampening portion for engaging a motor component or housing.

FIG. 2 is bottom plan view of an appliance 100 and dampening member 110. In the current embodiment, dampening member 110 includes outer side surfaces 202, 204, 206, and 208. Surfaces 202-208 can be configured for physical communication with at least a portion of the side walls 104 of the cabinet 102. Surfaces 202-208 also need not be linear or planar and can include undulating, wavy, and/or repeating and non-repeating geometric patterns. Hence, surfaces 202-208 need not make continuous physical communication with the cabinet side walls and can include intermittent physical communication as well. The physical communication can take the form of pressure, friction, adhesive, glue, fasteners, brackets and the like. Any manner suitable to substantially maintain dampening member 110 in its relative position in cavity 116 is suitable.

Dampening member 110 also includes inner surfaces 216, 218, 220 and 222, which bound and form space 114. In other embodiments, dampening member 110 can include more or less inner surfaces. For example, three inner surfaces can be provided thereby providing a triangular space. The inner space 114 may be cylindrical. Similarly, five or more inner surfaces may be provided to provide a pentagonal or other polygonal space. Still further, the inner surfaces need not form a symmetrical shape for space 114. Still further yet, surfaces 216-222 also need not be linear or planar and can include undulating, wavy, and/or repeating and non-repeating geometric patterns.

In the examples illustrated by FIGS. 1A and 1B, insert the external rotor 173 spins at a high speed during operation of the washing machine. In one exemplary embodiment, the dampening member 110 is constructed such that the dampening member is not damaged if the spinning external rotor 173 engages the inner surface of the dampening member 110 during operation of the machine. For example, referring to FIGS. 1A and 1B, the dampening member 110 can be provided with a damage resistant layer 191 or skin. The damage resistant layer or skin may be a low friction and/or durable material that is not damaged when contacted by the spinning external rotor 173. The damage resistant layer may be made from a wide variety of different materials. Any material that has a lower coefficient of friction and/or a higher strength than the remainder of the dampening member 110 can be used. When the dampening member includes the damage resistant layer 191, the inner surface may be sized to contact the external rotor 173 during normal operation of the machine. Or, the inner surface may be sized such that the external rotor 173 only contacts the dampening member during abnormal operation, such as when the machine is loaded with an unbalanced load.

Dampening member 110 can also include intermediate surfaces 210 between outer surfaces 202-208. Surfaces 210 can be configured to form a cavity between side walls 104 of cabinet 102 to allow clearance for legs 112, which can typically be adjusted to extend and retract from cabinet 102 for leveling the appliance. As described above, surfaces 102 need not be linear and can include other contours.

Figure 3:
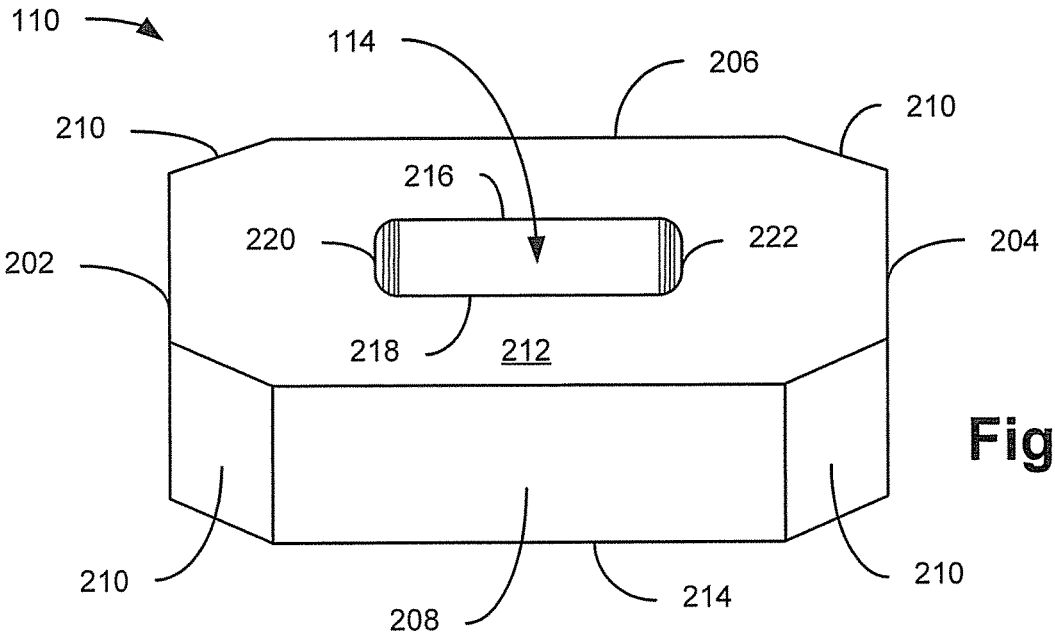
FIG. 3 is a perspective view of one embodiment of a dampening member.

FIG. 3 illustrates a perspective view of dampening member 110. Dampening member 110 includes surfaces 212 and 214 which can also be considered as top and bottom surfaces. Surfaces 212 and 214 also need not be linear or planar and can include undulating, wavy, and/or repeating and non-repeating geometric patterns.

Figure 4:
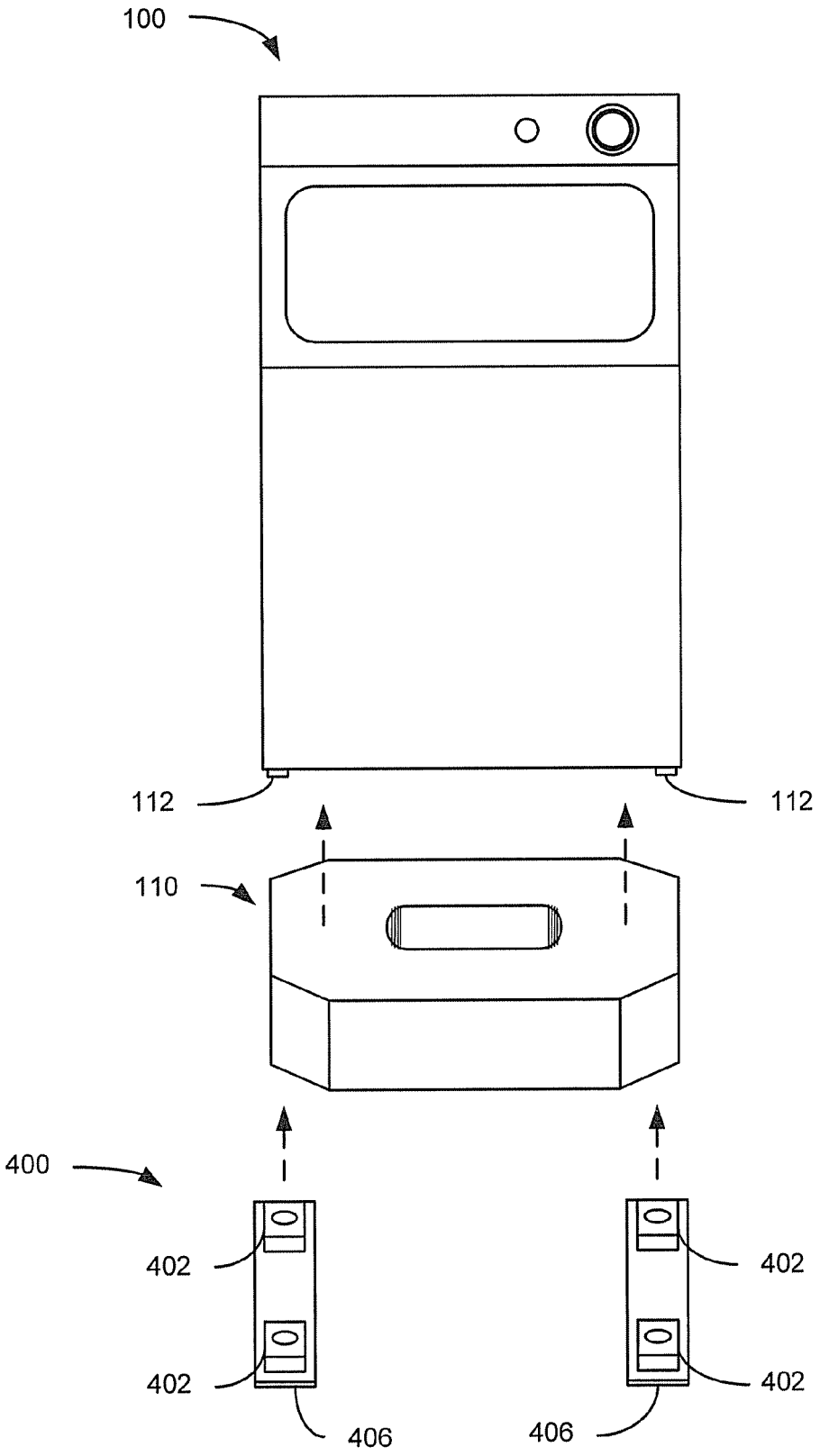
FIG. 4 is an exploded perspective view of an exemplary embodiment of an appliance, a dampening member, and a protective shipping structure.

FIG. 4 illustrates one embodiment of a shipping and operational dampening system. The system includes an appliance 100, dampening member 110 and protective assemblies 400 for the legs of appliance 100. The system is provided by inserting dampening member 110 into a cavity of appliance 100 proximate a moveable member such as a drive assembly 108. Dampening member 110 is placed in physical communication with at least a portion of one or more side walls of the cabinet 102 of appliance 100. Leg protective assemblies 400 include a protective member 402 for each leg of appliance 100 and one or more protective members 402 can be placed on a common strip 406. Protective assemblies 400 are positioned on legs 112 of appliance 100 and removably secured thereto by any suitable means including, for example, shipping tape or shrink wrap. Upon delivery of appliance 100 to its final destination, protective assemblies 400 can be removed and disposed. However, dampening member 110 remains inside the cabinet of appliance 100 to provide vibration dampening, acoustic and thermal insulation, and/or protection of components of the appliance during operation. In this manner, there is very little waste associated with packaging and shipping appliance 100. There is also the added benefit of the vibration dampening, acoustic and thermal insulation and/or protection of components of the appliance during operation.

Figure 5:
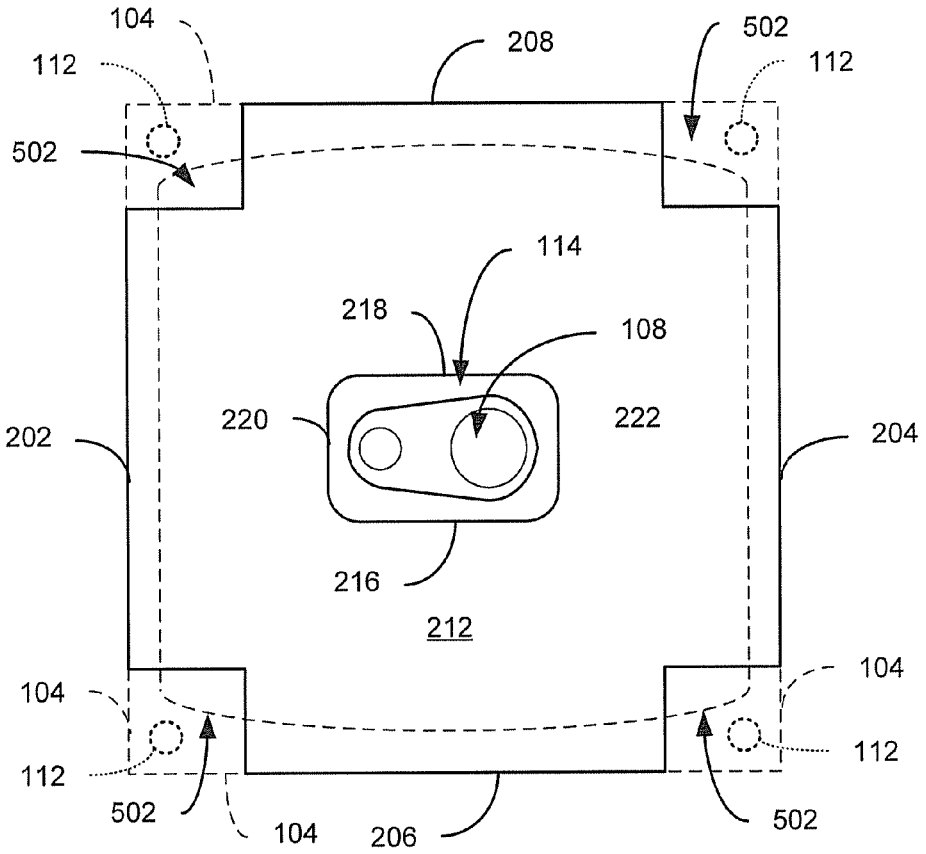
FIGS. 5-6 illustrate alternative embodiments of appliances having dampening members.
Figure 6:
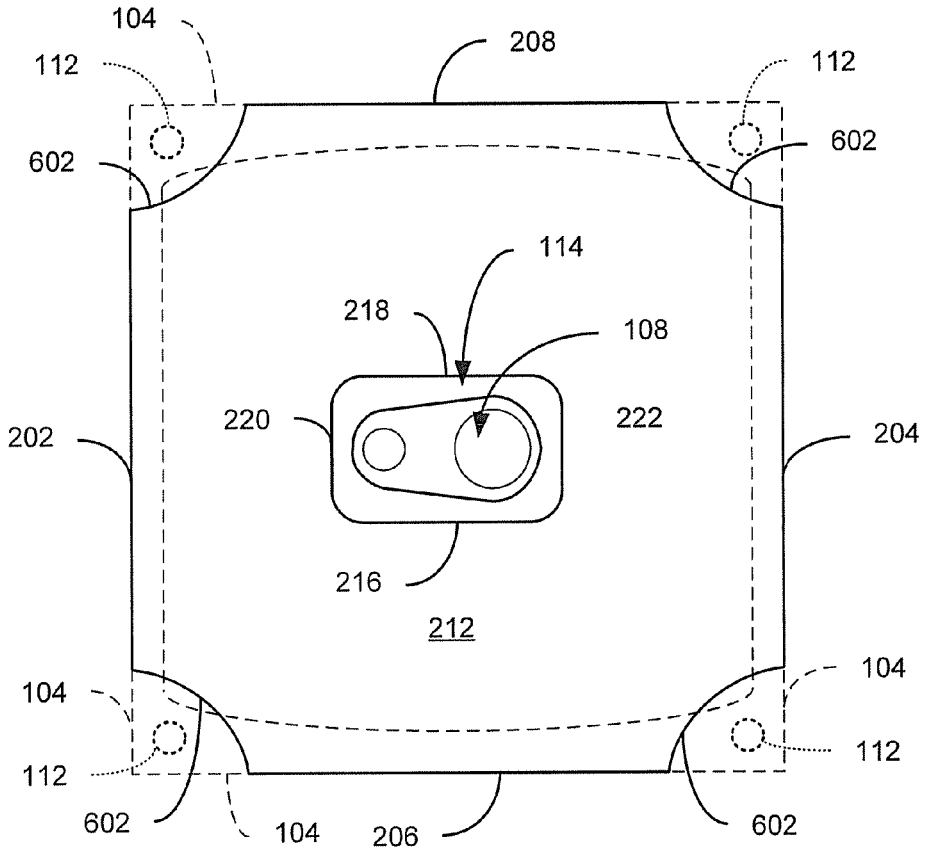

FIGS. 5 and 6 illustrate bottom plan views of alternative embodiments of dampening member 110. FIG. 5 illustrates an embodiment of a dampening member 110 having a plurality of transition surfaces 502 between outer surfaces 202-208. FIG. 6 illustrates an embodiment of a dampening member 110 having nonlinear transition surfaces 602. Additional embodiments of transition surfaces are also within the scope of the present invention such as, for example, transition surfaces having undulating, wavy, and/or repeating and non-repeating geometric patterns.

Figure 7:
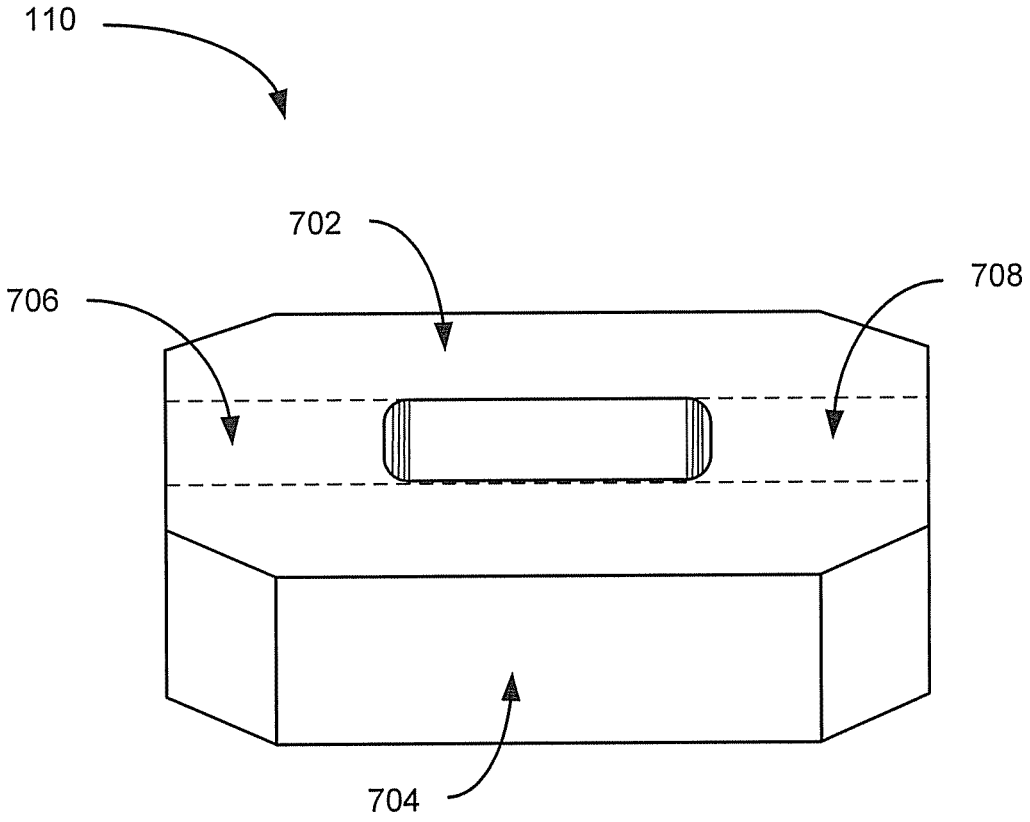
FIG. 7 illustrates yet another alternative embodiment of a dampening member.

FIG. 7 illustrates a perspective view of yet another embodiment of dampening member 110. In this embodiment, dampening member 110 has a body that includes a plurality of components or sections 702, 704, 706, and 708. The sections are placed in physical communication with each other to form the body of this embodiment of dampening member 110. In other embodiments, dampening member 110 can have a body made of more or less sections in physical communication with each other than shown in FIG. 7. Hence, the body of dampening member 110 can be, for example, a unitary body or a body made of multiple sections in physical communication with each other. Furthermore, the body of dampening member 110 need not be made of a single material and can include multiple materials either layered or dispersed. In one embodiment, section 702 and 704 can be made of a different material than section 706 and 708.

In this regard, dampening member 110 may be made from substantially any appropriate material including, but not limited to, material selected from a group consisting of a polyester, a polyester olefin blend, polyethylene terephthalate, polybutylene terephthalate, a polyethylene terephthalate and polypropylene blend, a polybutylene terephthalate and polypropylene blend and combinations thereof. These materials may or may not be fibrous in nature. As an alternative, dampening member 110 may be made from a laminated material including a core layer of fiberglass reinforced polymer material sandwiched between two wear layers of polyester material.

Polyester materials are particularly useful as construction material for the dampening member 110 as they exhibit excellent resiliency and wear resistance to provide a long service life. At the same time, the acoustic properties of the material may be tuned to better control noise and vibration.

This may be done by adjusting the density as well as the diameter and length of the fibers utilized in the material.

In addition, it should be appreciated that the dampening portion 110 may be further tuned to provide the desired spring rate for the most effective dampening of energy, motion or vibration emanating from the components internal to the cabinet 102. Typically, dampening member 110 provides a spring rate of between about 6.5 and about 102.0 pounds of force per 100 square inches of contact area. By increasing the amount of solid material in dampening member 110, the spring rate may be increased. Conversely, by reducing the amount of solid material in dampening member 110, the spring rate of the material may be reduced. Thus, by selecting a proper density and spring rate, it is possible to tune the spring rate to a desired level for the most efficient and effective dampening of vibrations. Typically, dampening member 110 will include between about 10 and about 90 percent solid material and between about 90 and about 10 percent open space. However, this is not critical as long as the dampening portion provides the appropriate protections during shipping and/or operation.

During operation, dampening member 110 reduces noise and vibration so as to provide smoother and more silent operation. The polyester material of the dampening member 110 is very resilient and scuff resistant so as to provide a long service life without any significant degradation of desired dampening properties. Other materials may be used which have similar properties.

In summary, numerous benefits result from employing the concepts of the present invention. The dampening member 110 protects appliance 100 by being placed in by at least partially filling a cavity with the appliance to protect the appliance from damage during shipment. Thus, potential damage to the appliance is prevented as it is transported from one location to another.

Following shipping, dampening member 110 remains providing operation vibration dampening. In addition, the material from which dampening member 110 is constructed provides acoustic benefits by reducing noise during operation and providing thermal insulation. Still further, dampening member 110 provides improved water management by catching and absorbing water that might be inadvertently spilled from the tub during operation of the washer and preventing that water from reaching the floor underneath the appliance. Further, it should be appreciated that the dampening member 110 is typically made from a polyester material which is resistant to the growth of bacteria, mildew and mold. Further, the material is hydrophobic by nature and, therefore dries quickly. In addition, such polyester material provides excellent wear resistance and will provide a long service life.

The foregoing description of the preferred embodiments of the present invention has been presented for purposes of illustration and description. It is not intended to be exhaustive or to limit the invention to the precise form disclosed. Modifications or variations are possible in light of the above teachings. For example, dampening member 110 can be made from a laminate comprising a core layer of fiberglass reinforced polymer material sandwiched between two wear layers of polyester based material.

The embodiments were chosen and described to illustrate the principles of the invention and its practical application. It is clear that modifications and variations are within the scope of the invention as determined by the appended claims. The drawings and preferred embodiments do not and are not intended to limit the ordinary meaning of the claims in their fair and broad interpretation in any way.

The invention claimed is:

1. An appliance comprising:

a housing comprising at least four side walls;

at least one moveable component inside the housing;

a drive assembly connected to the at least one moveable component; and a dampening member that protects the at least one moveable component during operation of the appliance, wherein the dampening member is disposed at least partially within the housing and in physical communication with the four side walls;

wherein the dampening member is disposed completely below the moveable component such that there is a vertical gap between the moveable component and the dampening member, the dampening member comprising a resilient material having at least one outer surface and at least one inner surface, the at least one inner surface proximate to, but spaced apart from, the drive assembly, wherein the dampening member remains in place during shipping and operation of the appliance;

wherein the drive assembly rotates relative to the housing during operation of the appliance; and wherein the appliance is selected from the group consisting of an air conditioner, a microwave oven, a refrigerator, a freezer, a clothes washing machine, a dryer, and a dish washer.

2. The appliance of claim 1 wherein the dampening member prevents damage to the appliance during shipping and handling of the appliance by limiting an amount of movement of the drive assembly with respect to the housing such that the at least one moveable component is prevented from moving with respect to the housing to an extent where the at least one moveable component hits the side walls.

3. The appliance of claim 2 wherein a space between the drive assembly and the inner surface of the dampening member defines the limit to said amount of movement.

4. The appliance of claim 2 wherein the appliance is a clothes washing machine and the at least one moveable component comprises a tub, and wherein the dampening member is configured to limit said amount of movement by engaging the drive assembly to prevent the tub from hitting the side wall.

5. The appliance of claim 2 wherein the appliance is a clothes washing machine, and wherein the at least one movable component comprises a tub of the clothes washing machine.

6. The appliance of claim 5 wherein the dampening member is configured to engage the drive assembly when the appliance is tilted with respect to a horizontal plane, and wherein engaging the drive assembly with the dampening member prevents the tub from hitting the side walls.

7. The appliance of claim 1 wherein the resilient material comprises a material selected from a group consisting of a polyester, a polyester olefin blend, polyethylene terephthalate, polybutylene terephthalate, a polyethylene terephthalate and polypropylene blend, a polybutylene terephthalate and polypropylene blend, and combinations thereof.

8. A clothes washing machine comprising: a housing comprising at least four side walls; a tub suspended in the housing; a drive assembly connected to the tub; and a dampening member that provides protection to the tub during operation of the clothes washing machine, wherein the dampening member is made from a resilient fibrous material selected from a group consisting of a polyester, a polyester olefin blend, polyethylene terephthalate, polybutylene terephthalate, a polyethylene terephthalate and polypropylene blend, a polybutylene terephthalate and polypropylene blend and combinations thereof; wherein the dampening member is disposed at least partially within the housing; wherein the dampening member is disposed below the tub such that there is a vertical gap between the tub and the dampening member; wherein the dampening member is in physical communication with the four side wall walls; wherein the dampening member comprises a resilient material having at least one outer surface and at least one inner surface, the at least one inner surface proximate to, but spaced apart from, the drive assembly;

wherein the dampening member remains in place during shipping and operation of the clothes washing machine; and wherein the drive assembly rotates relative to the housing during operation of the clothes washing machine.

9. The clothes washing machine of claim 8 wherein the dampening member prevents damage to the washing machine during shipping and handling of the washing machine by limiting an amount of movement of the drive assembly with respect to the housing such that the tub is prevented from moving with respect to the housing to an extent where the tub hits any of the side walls.

10. The clothes washing machine of claim 9 wherein a space between the drive assembly and the inner surface of the dampening member limits said amount of movement.

11. The clothes washing machine of claim 9 wherein the dampening member is configured to limit said amount of movement by engaging the drive assembly to prevent the tub from hitting the side walls.

12. The clothes washing machine of claim 8 wherein the dampening member is configured to engage the drive assembly when the washing machine is tilted with respect to a horizontal plane, wherein engaging the drive assembly with the dampening member prevents the tub from hitting the side walls.

13. The clothes washing machine of claim 8 wherein the dampening member is configured to engage an outer housing of the drive assembly that is fixed relative to the tub.

14. The clothes washing machine of claim 8 wherein the dampening member is configured to engage an external rotor of the drive assembly that spins relative to the tub during operation of the clothes washing machine.

15. A clothes washing machine comprising: a housing comprising at least four side walls; a tub suspended in the housing; a drive assembly connected to the tub; and a dampening member that protects the tub during operation of the clothes washing machine, wherein the dampening member is disposed at least partially within the housing; wherein the dampening member is made from a resilient fibrous material; wherein the dampening member is disposed completely below the tub such that there is a vertical gap between the tub and the dampening member; wherein the dampening member is in physical communication with the at least one the four side wall walls; wherein the dampening member comprises a resilient material having at least one outer surface and at least one inner surface, the at least one inner surface proximate to, but spaced apart from, the drive assembly; wherein a space between the drive assembly and said inner surface of the dampening member is selected to limit an amount of movement of the drive assembly with respect to the housing such that the tub is prevented from moving with respect to the housing to an extent where the tub hits the side walls;

wherein the dampening member remains in place during shipping and operation of the clothes washing machine; and wherein the drive assembly rotates relative to the housing during operation of the clothes washing machine; and wherein the drive assembly rotates relative to the housing during operation of the clothes washing machine.

16. The clothes washing machine of claim 15 wherein the dampening member is configured to engage the drive assembly when the washing machine is tilted with respect to a horizontal plane, wherein engaging the drive assembly with the dampening member prevents the tub from hitting the side walls.

17. The clothes washing machine of claim 15 wherein the dampening member is configured to engage an outer housing of the drive assembly that is fixed relative to the tub.

18. The clothes washing machine of claim 15 wherein the dampening member is configured to engage an external rotor of the drive assembly that spins relative to the tub during operation of the washing machine.

19. The clothes washing machine of claim 15, wherein the resilient material comprises a material selected from a group consisting of a polyester, a polyester olefin blend, polyethylene terephthalate, polybutylene terephthalate, a polyethylene terephthalate and polypropylene blend, a polybutylene terephthalate and polypropylene blend and combinations thereof.

* * * * *